US008177032B2

(12) United States Patent
Hashimoto

(10) Patent No.: US 8,177,032 B2
(45) Date of Patent: May 15, 2012

(54) ELEVATOR HAVING REGENERATIVE VOLTAGE CONTROL

(75) Inventor: Jun Hashimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 428 days.

(21) Appl. No.: 12/518,344

(22) PCT Filed: Feb. 14, 2007

(86) PCT No.: PCT/JP2007/052589

§ 371 (c)(1),
(2), (4) Date: Jun. 9, 2009

(87) PCT Pub. No.: WO2008/099470

PCT Pub. Date: Aug. 21, 2008

(65) Prior Publication Data

US 2010/0078267 A1 Apr. 1, 2010

(51) Int. Cl.
*B66B 1/06* (2006.01)

(52) U.S. Cl. ..... 187/290; 187/293

(58) Field of Classification Search ..... 187/247, 187/293, 296, 290, 391–393; 318/362, 375, 318/376, 798–815

See application file for complete search history.

(56) References Cited

U.S. PATENT DOCUMENTS

| | | | | |
|---|---|---|---|---|
| 6,422,351 | B2 * | 7/2002 | Tajima et al. | 187/290 |
| 6,439,348 | B2 * | 8/2002 | Tajima et al. | 187/290 |
| 6,471,013 | B2 * | 10/2002 | Banno et al. | 187/290 |
| 6,522,099 | B2 * | 2/2003 | Tominaga et al. | 318/801 |
| 6,533,074 | B2 * | 3/2003 | Tominaga et al. | 187/290 |
| 2009/0301819 | A1 * | 12/2009 | Agirman et al. | 187/290 |
| 2010/0044160 | A1 * | 2/2010 | Agirman et al. | 187/290 |

FOREIGN PATENT DOCUMENTS

| | | |
|---|---|---|
| JP | 61 162477 | 7/1986 |
| JP | 62 126089 | 6/1987 |
| JP | 2003 238037 | 8/2003 |
| JP | 2004 137003 | 5/2004 |
| WO | 2007 013141 | 2/2007 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

A car is suspended by suspension means and raised and lowered by a hoisting machine. Electric power supplied to a motor of the hoisting machine is controlled by an electric power converter. The electric power converter is controlled by a control apparatus. The control apparatus estimates a maximum value of a regenerative voltage at time of a regenerative operation of the hoisting machine when the car is running. When the estimated maximum value of the regenerative voltage reaches a predetermined voltage limit value, the control apparatus controls the electric power converter so as to stop an increase in estimated maximum value of the regenerative voltage.

4 Claims, 2 Drawing Sheets

ELEVATOR HAVING REGENERATIVE VOLTAGE CONTROL

TECHNICAL FIELD

The present invention relates to an elevator apparatus which efficiently uses capabilities of drive equipments to operate a car with high efficiency.

BACKGROUND ART

In a conventional elevator control apparatus, a speed of a car when the car runs at a constant speed and acceleration/deceleration when the car runs at an increasing/reducing speed are varied according to loads in the car within a driving range of a motor and electric equipments for driving the motor. As a result, remaining power of the motor is utilized to improve a travel efficiency of the car (for example, see Patent Document 1).

Patent Document 1: Japanese Patent Application Laid-open No. 2003-238037

DISCLOSURE OF THE INVENTION

Problem to be Solved by the Invention

In the conventional elevator control apparatus as described above, use of regenerative electric power generated from the motor must be taken into consideration. However, how to deal with the regenerative electric power is not clear. Therefore, a regenerative voltage exceeds a limit value of a voltage to fail to obtain an expected deceleration. As a result, there is fear that the car may travel beyond its stop position.

The present invention has been made to solve the problem described above, and therefore has an object of obtaining an elevator apparatus capable of appropriately consuming regenerative electric power while operating a car with high efficiency.

Means for Solving the Problem

An elevator apparatus according to the present invention includes: a hoisting machine including a driving sheave and a motor for rotating the driving sheave; suspension means wound around the driving sheave; a car suspended by the suspension means to be raised and lowered by the hoisting machine; an electric power converter for controlling electric power supplied to the motor; and a control apparatus for controlling the electric power converter, in which the control apparatus estimates a maximum value of a regenerative voltage at time of a regenerative operation of the hoisting machine when the car is running, and controls the electric power converter so as to stop an increase in estimated maximum value of the regenerative voltage when the estimated maximum value of the regenerative voltage reaches a predetermined voltage limit value.

BEST MODE FOR CARRYING OUT THE INVENTION

Hereinafter, a preferred embodiment of the present invention is described in reference to the drawings.

First Embodiment

Figure 1:
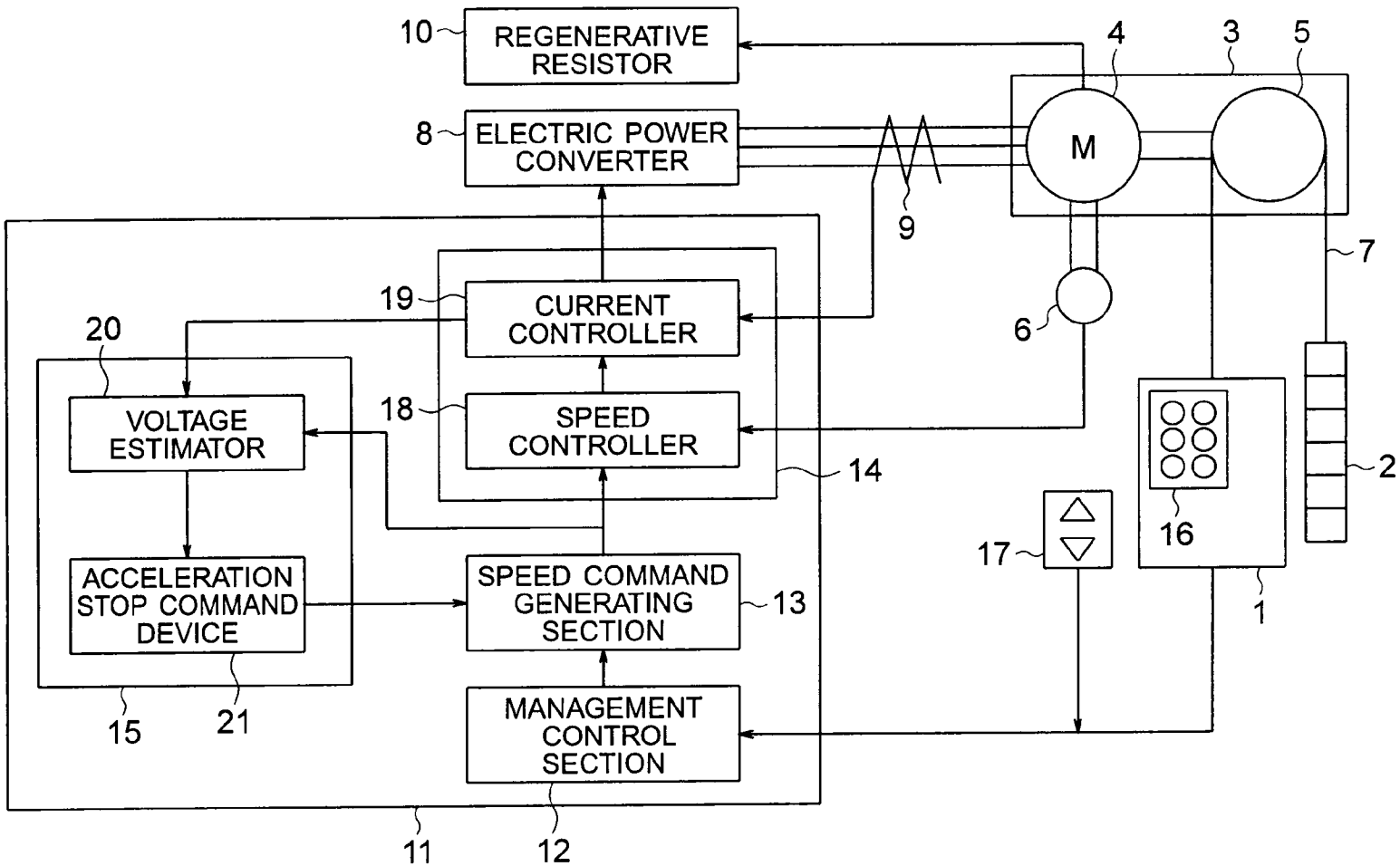
FIG. 1 A configuration diagram illustrating an elevator apparatus according to a first embodiment of the present invention.

FIG. 1 is a configuration diagram illustrating an elevator apparatus according to a first embodiment of the present invention. A car 1 and a counterweight 2 are raised and lowered by a hoisting machine 3 in a hoistway. The hoisting machine 3 includes a motor 4, a driving sheave 5 rotated by the motor 4, and a brake (not shown) for braking a rotation of the driving sheave 5.

A speed detector 6 for detecting a rotation speed and a position of a magnetic pole of the motor 4 is provided to the motor 4. As the speed detector 6, for example, an encoder, a resolver or the like is used.

A plurality of main ropes 7 (only one of them is illustrated in FIG. 1) as suspension means for suspending the car 1 and the counterweight 2 are wound around the driving sheave 5. As each of the main ropes 7, for example, a normal rope, a belt-like rope or the like can be used.

Electric power from a power supply is supplied through an electric power converter 8 to the motor 4. As the electric power converter 8, for example, a PWM-controlled inverter for generating a plurality of pulses of a DC voltage with a fundamental frequency of an AC voltage to adjust an output voltage is used. In such an inverter as described above, a switching duty ratio of the voltage is adjusted to vary the output voltage to the motor 4.

A breaker (not shown) is provided between the electric power converter 8 and the power supply. An overcurrent is prevented from flowing to the electric power converter 8 by the breaker. A value of a current supplied from the electric power converter 8 to the motor 4 is detected by a current detector (CT) 9 as a motor current value.

A regenerative resistor 10 consumes the electric power which is generated by the motor 4 during a regenerative operation of the hoisting machine 3 as heat. In this case, a line voltage applied to the motor 4 is limited by a capacity of the regenerative resistor 10. On the other hand, an elevator apparatus without the regenerative resistor 10 controls the electric power generated by the motor 4 with a matrix converter or simple regeneration to return the electric power back to the power supply. In this case, the line voltage applied to the motor 4 is limited by a power supply voltage.

The electric power converter 8 is controlled by a control apparatus 11. The control apparatus 11 generates a speed command to increase a maximum speed or an acceleration of the car 1 as much as possible within an allowable range for drive system equipments to reduce a running time of the car 1. The control apparatus 11 includes a management control section 12, a speed command generating section 13, a movement control section 14, and a speed limiting section 15. The management control section 12 generates travel management information relating to an operation of the elevator apparatus (for example, a destination floor for the car 1, information of a running command and the like) based on information from a car operating panel 16 and a landing operating panel 17.

The speed command generating section 13 generates a speed command for the car 1, specifically, a speed command for the hoisting machine 3 based on the travel management information from the management control section 12, and outputs the generated speed command to the movement control section 14 and the speed limiting section 15. The speed command generating section 13 obtains, by a calculation, a virtual speed pattern from the start of reduction of the acceleration to the stop of the car at a destination floor at each time point during constant acceleration, calculates a travel distance during constant acceleration/deceleration that the car travels from the current time to the start of the constant deceleration in the obtained speed pattern, and outputs the obtained travel distance to the speed limiting section 15.

The movement control section 14 controls the movement of the car 1 based on the speed command from the speed command generating section 13. The car 1 is moved by the control of the movement control section 14 on the electric power converter 8. The movement control section 14 includes a speed controller 18 and a current controller 19.

The speed controller 18 obtains a difference between the speed command from the speed command generating section 13 and information of the rotation speed from the speed detector 6 as speed deviation information, and outputs the obtained speed deviation information to the current controller 19. The current controller 19 obtains a motor current target value based on the speed deviation information from the speed controller 18, and controls the electric power converter 8 to allow the motor current value detected by the current detector 9 to be equal to the motor current target value.

A control command contains a motor current command for adjusting the motor current to be supplied to the motor 4, a torque current command for adjusting a torque current for causing the motor 4 to generate a rotary torque, and a voltage command for adjusting the voltage to be supplied to the motor 4. The voltage command contains information of the switching duty ratio of the voltage for the motor 4.

The current controller 19 obtains a component in the motor current detected by the current detector 9, which causes the motor 4 to generate the rotary torque, as a torque current, and outputs information of the obtained torque current to the speed limiting section 15. The motor current value, a motor current command value, a torque current value, a torque current command value, a voltage command value, and the switching duty ratio of the voltage for the motor 4 are associated with the output of the hoisting machine 3, and hence the above-mentioned values correspond to driving information according to the output of the hoisting machine 3 when the hoisting machine 3 moves the car 1.

When the car starts running at a reducing acceleration at each time point during the running with the constant acceleration, the speed limiting section 15 estimates, by computation, a maximum value of the regenerative voltage which can be generated by the motor 4 during the running. When the maximum value of the regenerative voltage reaches a limit value, the speed limiting section 15 outputs an acceleration stop command to the speed command generating section 13. The speed limiting section 15 includes a voltage estimator 20 and an acceleration stop command device 21.

When the hoisting machine 3 performs the regenerative operation, the regenerative voltage becomes maximum at a time point t' at which the running transits to the running with constant deceleration after the acceleration is reduced from a constant running speed. The voltage estimator 20 estimates a voltage $V_a'$ at the time point t' from the speed command and the travel distance during the constant acceleration/deceleration from the speed command generating section 13, and the torque current command value from the movement control section 14. The voltage estimator 20 also outputs the estimated value $V_a'$ of the maximum regenerative voltage to the acceleration stop command device 21.

The acceleration stop command device 21 compares the estimated value $V_a'$ of the maximum regenerative voltage from the voltage estimator 20 and the voltage limit value, and outputs the acceleration stop command to the speed command generating section 13 when the value $V_a'$ reaches the voltage limit value. Upon reception of the information of the acceleration stop command from the acceleration stop command device 21 while the speed is being increased at a constant rate by the speed command, the speed command generating section 13 reduces the acceleration to 0 during an acceleration jerk time $t_a$ for the speed command to the car 1 to transit to the running at a constant speed. Specifically, when an estimated value of the line voltage applied to the motor 4 is smaller than the limit value, the speed command generating section 13 obtains the speed command for canceling the stop of the constant acceleration. As a result, the line voltage applied to the motor 4 can be prevented from being higher than the limit value.

The control apparatus 11 includes a computer having an arithmetic processing section (a CPU or the like), a storage section (a ROM, a RAM, a hard disk and the like), and a signal input/output section. Specifically, the functions of the control apparatus 11 are realized by the computer. The control apparatus 11 repeatedly performs computation processing for each computation cycle $t_s$.

Next, an operation is described. When a call registration is performed by an operation of at least any one of the car operating panel 16 and the landing operating panel 17, information of the call registration is transmitted to the control apparatus 11. Thereafter, when a start command is input to the control apparatus 11, the electric power is supplied from the electric power converter 8 to the motor 4 while the brake of the hoisting machine 3 is released, thereby starting the movement of the car 1. Thereafter, the speed of the car 1 is adjusted by the control of the control apparatus 11 performed on the electric power converter 8, and the car 1 is moved to the destination floor for which the call registration is made.

Next, a specific operation of the control apparatus 11 is described. The acceleration stop command device 21 performs any one of judgment for the possibility of the constant acceleration and judgment for the acceleration stop command based on the estimated value of the line voltage applied to the motor 4. When the information of the call registration is input to the control apparatus 11, the travel management information is generated by the management control section 12 based on the input information.

Thereafter, when the judgment of the acceleration stop command device 21 is for the possibility of the constant acceleration, a set speed, specifically, the speed command is obtained by the speed command generating section 13 based on the travel management information from the management control section 12. The speed command is calculated by a preset calculation formula.

When the judgment of the acceleration stop command device 21 is for the acceleration stop command, the speed command for reducing the acceleration is calculated by the speed command generating section 13 based on the travel management information from the management control section 12. The calculation of the speed command by the speed command generating section 13 as described above is performed for each computation cycle $t_s$.

Thereafter, the electric power converter 8 is controlled by the movement control section 14 according to the calculated speed command, thereby controlling the speed of the car 1.

Next, a method of estimating the regenerative voltage is described. In a synchronous motor, the regenerative voltage becomes higher as the rotation speed and the torque increase. Therefore, the regenerative voltage becomes maximum between the end of running at a constant speed (a time at which the rotation speed becomes maximum) and the start of the constant deceleration (a time at which a deceleration torque becomes maximum). The rotation speed is reduced and the deceleration torque is increased by the increased deceleration in this period. However, the regenerative voltage is affected more by the torque than by the rotation speed, and hence the regenerative voltage is considered to become maximum at the start of the constant deceleration. Therefore, the regenerative voltage at this time is estimated as the maximum value of the line voltage applied to the motor 4 for the speed reduction.

Here, from the following circuit equation of a d-axis and a q-axis, it is understood that the d-axis and the q-axis have speed electromotive forces which interact with each other.

[Equation 1]

$$\begin{bmatrix} V_{da} \\ V_{qa} \end{bmatrix} = \begin{bmatrix} R_a + P \cdot L_a & -\omega_{re} \cdot L_a \\ \omega_{re} \cdot L_a & R_a + P \cdot L_a \end{bmatrix} \begin{bmatrix} i_{da} \\ i_{qa} \end{bmatrix} + \begin{bmatrix} 0 \\ \omega_{re} \cdot \phi_{fa} \end{bmatrix} \quad (1)$$

The d and q voltages are controlled as expressed by the following equation to perform non-interacting control for canceling the speed electromotive forces.

[Equation 2]

$$\begin{aligned} V_{da} &= V'_{da} - W_{re} \cdot L_a \cdot I_{qa} \\ V_{qa} &= V'_{qa} + W_{re}(\phi_{fa} + L_a \cdot i_{qa}) \end{aligned} \quad (2)$$

Therefore, the line voltage is obtained by the following formula.

$$V_a^2 = V_{da}^2 + V_{qa}^2 = (V'_{da} - w_{re} \cdot L_a \cdot I_{qa})^2 + \{V'_{qa} + w_{re}(\Phi_{fa} + L_a \cdot i_{qa})\}^2$$

Here, an electrical angular speed $w_{re}'$, a d-axis current $I_d'$ and a q-axis current $I_q'$ at the time point t' for starting the constant deceleration, at which the regenerative voltage becomes maximum, are estimated to obtain the regenerative voltage $V_a'$ by using Formula (1). In this Formula, $R_a$ is a resistance value, $L_a$ is an inductance, and $\Phi_{fa}$ is a maximum value of flux linkages of an armature winding.

$$V_a'^2=(R_a \cdot I_d' - L_a \cdot I_q' \cdot w_{re}')^2+\{R_a \cdot I_d' + w_{re}'(\Phi_{fa}+L_a \cdot I_d')\} \quad (1)$$

The estimation of the electrical angular speed $w_{re}'$ is obtained by Formula (2) from a current speed v, an acceleration $A_a$ and a deceleration $A_d$ during running with the constant deceleration. In this Formula, $t_a$ is the acceleration jerk time, $t_d$ is a deceleration jerk time, $D_s$ is a diameter of the driving sheave 5, and p is the number of poles of the motor 4.

$$w_{re}'=\{v+(A_a \cdot t_a - A_d \cdot t_d)/2\} \cdot (2/D_s) \cdot p \quad (2)$$

In the case where the regenerative voltage $V_a'$ generated by the motor 4 reaches the limit value, the motor 4 rotates at high speed. In order to cancel a counter electromotive force generated by the high-speed rotation, a large d-axis current flows. In this case, assuming that the d-axis current as large as the limit value flows, the estimated value $I_d'$ of the d-axis current at the time point t' is determined as expressed by Formula (3), where $I_{dmax}$ is a maximum value of the d-axis current.

$$I_d'=I_{dmax} \quad (3)$$

The q-axis current is proportional to the torque generated by the motor 4. The torque is roughly divided into an acceleration torque proportional to the acceleration, a load torque proportional to a load or a state of rope unbalance, and a loss torque inversely proportional to the speed. Therefore, changes in three torque components from each time point t during the constant acceleration to the time point t' for starting the constant deceleration are estimated to be added to the torque at the time point t, thereby estimating the q-axis current.

A change $\Delta T_{acc}$ in acceleration torque is obtained by Formula (4) from the acceleration $A_a$ and the constant deceleration $A_d$ at the time point t. A acceleration conversion coefficient $K_l$ is expressed by Formula (5) using a gear ratio k and an inertia moment $G_{D2}$.

$$\Delta T_{acc}=(A_a+A_d) \cdot K_l \quad (4)$$

$$K_l=D_s \cdot k \cdot 19.6/G_{D2} \quad (5)$$

A change $\Delta T_{ld}$ in load torque is estimated from a change ΔRub in rope unbalance, assuming that the load in the car 1 during running is constant. First, a time $t_2$ for constant deceleration is obtained by Formula (6) using the constant acceleration $A_a$, the constant deceleration $A_d$, a time $t_1$ for constant acceleration, a start jerk time $t_j$, the acceleration jerk time $t_a$, the deceleration jerk time $t_d$, and a landing jerk time $t_L$, at the time point t during the constant acceleration.

$$t_2=(A_a/A_d)(t_l+(t_j+t_a)/2)-(t_d+t_L/2 \quad (6)$$

A difference Rub' in rope unbalance value between the time points t and t' is calculated by Formula (7) from a travel distance $L_{ad}$ during the constant acceleration/deceleration, which is obtained by the speed command generating section 13. In this Formula, a linear density of a rope system is ρ.

$$\text{Rub}'=L_{ad} \cdot \rho \quad (7)$$

A change in rope unbalance is obtained from the rope unbalance values Rub and Rub' corresponding to the positions of the car 1 at the time points t and t', and is also obtained as a change $\Delta T_{ld}$ in load torque as expressed by Formula (8).

$$\Delta T_{ld}=\Delta\text{Rub}=\text{Rub}'-\text{Rub} \quad (8)$$

A change $\Delta T_{loss}$ in loss torque is inversely proportional to a difference in speed between the time points t and t'. The difference in speed is small, and hence it is considered that there is no change in loss torque.

$$\Delta T_{loss}=0 \quad (9)$$

The torque current $I_q'$ at the time point t' is expressed by Formula (10), where a torque constant $K_2$ is expressed by Formula (11) using the number of poles p and the maximum value $\Phi_{fa}$ of the flux linkage of the armature winding.

$$I_q'=I_q+(\Delta T_{acc}+\Delta T_{ld}+\Delta T_{loss}) \cdot K_2 \quad (10)$$

$$K_2=p \cdot \Phi_{fa} \quad (11)$$

Figure 2:
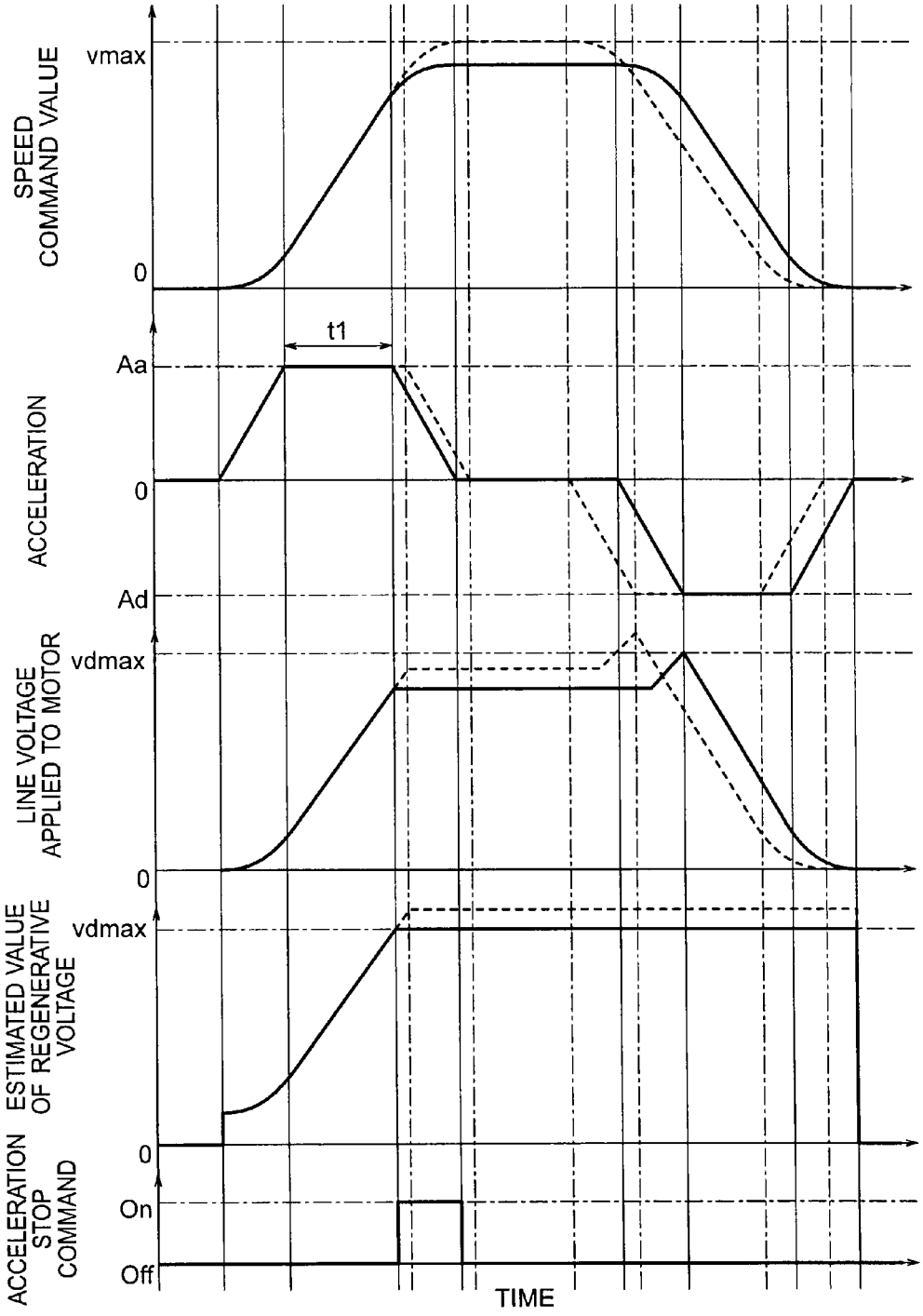
FIG. 2 A graph illustrating an example of changes with time in speed command value, acceleration, line voltage applied to a motor, estimated value of a regenerative voltage, and acceleration stop command in the elevator apparatus illustrated in FIG. 1.

Next, the speed command from the speed command generating section 13 when the motor 4 performs the regenerative operation is described. FIG. 2 is a graph illustrating an example of changes with time in speed command value, acceleration, line voltage applied to the motor, estimated value of the regenerative voltage, and acceleration stop command in the elevator apparatus illustrated in FIG. 1.

In FIG. 2, dotted lines indicating the speed command value and the acceleration on the graph correspond to the speed/acceleration pattern calculated by the speed command generating section 13 based on the information from the management control section 12 at the time of starting the operation of the elevator. The car 1 is initially caused to run according to the pattern. However, depending on a condition of the load in the car or a running condition, the regenerative voltage becomes extremely high. As a result, the line voltage applied to the motor at the start of the constant deceleration exceeds a voltage limit value $V_{dmax}$ (a dotted line on the graph for the line voltage).

In order to prevent the line voltage from exceeding its limit value, the maximum value of the regenerative voltage is estimated during the running at the constant acceleration. When the maximum value reaches the voltage limit value $V_{dmax}$, the acceleration stop command is output to the speed command generating section 13. Upon reception of the acceleration stop command, the speed command generating section 13 reduces the acceleration to perform control so as to stop the increase in estimated maximum value of the regenerative voltage. Moreover, from the speed at the start of reduction of the acceleration, the acceleration, and a distance to a stop position, a new speed/acceleration pattern (solid lines on the graph for the speed command value and the acceleration) is created to be output to the movement control section 14.

In the elevator apparatus described above, the maximum speed is determined during the constant acceleration while the regenerative voltage is prevented from exceeding the voltage limit value. Therefore, the regenerative electric power can be appropriately consumed. Moreover, the speed of the car 1 can be increased at a constant rate until the regenerative voltage reaches the voltage limit value as long as the loads on the other driving system equipments are within an allowable range, and hence the car 1 can be operated with high efficiency.

The invention claimed is:

1. An elevator apparatus, comprising:

a hoisting machine including a driving sheave and a motor for rotating the driving sheave;

suspension means wound around the driving sheave;

a car suspended by the suspension means to be raised and lowered by the hoisting machine;

an electric power converter for controlling electric power supplied to the motor; and a control apparatus for controlling the electric power converter, wherein the control apparatus estimates a maximum value of a regenerative voltage at time of a regenerative operation of the hoisting machine when the car is running, and controls the electric power converter so as to stop an increase in estimated maximum value of the regenerative voltage when the estimated maximum value of the regenerative voltage reaches a predetermined voltage limit value.

2. An elevator apparatus, comprising:

a hoisting machine including a driving sheave and a motor for rotating the driving sheave;

suspension means wound around the driving sheave;

a car suspended by the suspension means to be raised and lowered by the hoisting machine;

an electric power converter for controlling electric power supplied to the motor; and a control apparatus for controlling the electric power converter, wherein the control apparatus estimates a maximum value of a regenerative voltage at time of a regenerative operation of the hoisting machine when the car is running, and controls the electric power converter so as to stop an increase in estimated maximum value of the regenerative voltage when the estimated maximum value of the regenerative voltage reaches a predetermined voltage limit value, wherein the control apparatus reduces an acceleration of the car to stop the increase in estimated maximum value of the regenerative voltage.

3. An elevator apparatus, comprising:

a hoisting machine including a driving sheave and a motor for rotating the driving sheave;

suspension means wound around the driving sheave;

a car suspended by the suspension means to be raised and lowered by the hoisting machine;

an electric power converter for controlling electric power supplied to the motor; and a control apparatus for controlling the electric power converter, wherein the control apparatus estimates a maximum value of a regenerative voltage at time of a regenerative operation of the hoisting machine when the car is running, and controls the electric power converter so as to stop an increase in estimated maximum value of the regenerative voltage when the estimated maximum value of the regenerative voltage reaches a predetermined voltage limit value, wherein:

the motor is a synchronous motor driven by a d-axis current and a q-axis current; and the control apparatus estimates the maximum value of the regenerative voltage based on the d-axis current, the q-axis current, and an angular speed of the motor.

4. An elevator apparatus according to claim 3, wherein the control apparatus sets the d-axis current to a predetermined value and the q-axis current to a value determined based at least on an acceleration torque.

* * * * *